US008127481B2

(12) United States Patent
Rozum et al.

(10) Patent No.: US 8,127,481 B2
(45) Date of Patent: Mar. 6, 2012

(54) MODEL 1911 SEMIAUTOMATIC PISTOL THUMB SAFETY

(75) Inventors: Gregory T. Rozum, Thomaston, CT (US); Jerold R. Crowley, Colchester, CT (US); Paul M. Hochstrate, Plantsville, CT (US); Martinho Tavares, Conventry, CT (US)

(73) Assignee: Colt's Manufacturing Company Inc., West Hartford, CT (US)

( * ) Notice: Subject to any disclaimer, the term of this patent is extended or adjusted under 35 U.S.C. 154(b) by 686 days.

(21) Appl. No.: 11/861,625

(22) Filed: Sep. 26, 2007

(65) Prior Publication Data

US 2012/0023801 A1 Feb. 2, 2012

(51) Int. Cl.
*F41A 17/00* (2006.01)

(52) U.S. Cl. ..... 42/70.08; 42/70.01

(58) Field of Classification Search ..... 42/70.01, 42/70.08, 70.11; 89/148; D22/108, 100, D22/199, 104

See application file for complete search history.

(56) References Cited

U.S. PATENT DOCUMENTS

| | | | | | |
|---|---|---|---|---|---|
| 3,492,748 | A * | 2/1970 | Swenson | 42/70.01 |
| 4,208,947 | A * | 6/1980 | Hillberg | 89/148 |
| D260,548 | S * | 9/1981 | Holland | D22/108 |
| 4,742,634 | A * | 5/1988 | Swenson | 42/70.01 |
| 5,212,327 | A * | 5/1993 | Schuemann | 42/70.01 |
| 5,903,994 | A * | 5/1999 | Tange | 42/70.01 |
| D415,238 | S * | 10/1999 | Kay | D22/108 |
| 6,560,909 | B2 * | 5/2003 | Cominolli | 42/70.05 |
| 6,907,814 | B2 * | 6/2005 | Spinner et al. | 89/180 |
| 2004/0200112 | A1 * | 10/2004 | Beretta | 42/70.01 |
| 2007/0137472 | A1 * | 6/2007 | Thomele | 89/190 |

* cited by examiner

*Primary Examiner* — Michael Carone
*Assistant Examiner* — Reginald Tillman, Jr.
(74) *Attorney, Agent, or Firm* — Perman & Green, LLP

(57) ABSTRACT

A model 1911 semiautomatic pistol thumb safety or decocking lever adapted to be coupled to a model 1911 receiver. The thumb safety has a selector pivotally coupled about an axis of rotation to a side of the model 1911 receiver the selector having a flat surface portion offset from the axis of rotation and contacting the side. The selector has a raised surface portion offset from the axis of rotation and facing the side. The safety is adapted to be selectable from a first position to a second position. The flat surface portion covers a swept area when the safety is rotated from the first position to the second position. The swept area is covered by the raised surface portion in either the first position or the second position.

19 Claims, 9 Drawing Sheets

MODEL 1911 SEMIAUTOMATIC PISTOL THUMB SAFETY

BACKGROUND

1. Field

The disclosed embodiments relate to a firearm safety and, more particularly, to a model 1911 semiautomatic pistol thumb safety.

2. Description of Earlier Related Developments

Single and double action semi automatic pistols such as the compact pistol disclosed in U.S. Pat. No. 6,000,162 which is hereby incorporated by reference in its entirety have been used broadly. A very popular and prevalent pistol configuration is the model 1911 pistol configuration, such as made by Colt's Manufacturing Corp. The model 1911 pistol has had broad and extended historical use, bringing the model 1911 world renown that is well deserved. With a slim shape, and historical renown, the model 1911 continues as a highly desired firearm. As a highly desired firearm, maintaining the appearance and finish of the model 1911 is a high priority for many owners. A problem arises when the firearm is used extensively and the finish may be otherwise compromised by moving parts. As an example, a safety selector may be rotated between two or more positions. Here, the selector sweeps across the firearms receiver or other parts making a distinguishable pattern on the receiver that may devalue the firearm. Accordingly, there is a desire to provide a movable selector that does not provide a distinguishable pattern on the receiver with continued use.

SUMMARY OF THE EXEMPLARY EMBODIMENTS

In accordance with one exemplary embodiment a model 1911 semiautomatic pistol thumb safety adapted to be coupled to a model 1911 receiver is provided. The thumb safety has a selector pivotally coupled about an axis of rotation to a side of the model 1911 receiver. The selector has a flat surface portion offset from the axis of rotation and contacting the side. The selector has a raised surface portion offset from the axis of rotation and facing the side. The safety is adapted to be selectable from a first position to a second position. The flat surface portion covers a swept area when the safety is rotated from the first position to the second position. The swept area is covered by the raised surface portion in either the first position or the second position.

In accordance with another exemplary embodiment, a model 1911 semiautomatic pistol ambidextrous thumb safety adapted to be coupled to a model 1911 receiver is provided. The ambidextrous thumb safety has a right selector pivotally coupled about an axis of rotation to a first side of the model 1911 receiver. The right selector has a right flat surface portion offset from the axis of rotation and contacting the first side. The right selector has a right raised surface portion offset from the axis of rotation and facing the first side. A left selector is provided pivotally coupled about the axis of rotation to a second side of the model 1911 receiver opposite the first side. The left selector is interconnected to the right selector. The left selector has a left flat surface portion offset from the axis of rotation and contacting the second side. The left selector has a left raised surface portion offset from the axis of rotation and facing the second side. The safety is adapted to be selectable from a first position to a second position. The right flat surface portion covers a first swept area when the safety is rotated from the first position to the second position. The right swept area is covered by the right raised surface portion in either the first position or the second position. The left flat surface portion covers a second swept area when the safety is rotated from the first position to the second position. The left swept area is covered by the left raised surface portion in either the first position or the second position.

In accordance with yet another exemplary embodiment, a semiautomatic pistol is provided. The semiautomatic pistol has a receiver, a barrel coupled to the receiver, a breach slide coupled to the receiver and a firing mechanism coupled to the receiver. A selector is provided pivotally coupled about an axis of rotation to the receiver. The selector has a flat surface portion offset from the axis of rotation and contacting the receiver. The selector has a raised surface portion offset from the axis of rotation and facing the receiver. The selector is adapted to be selectable from a first position to a second position. The flat surface portion covers a first swept area when the selector is rotated from the first position to the second position. The first swept area is covered by the raised surface portion in either the first position or the second position.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
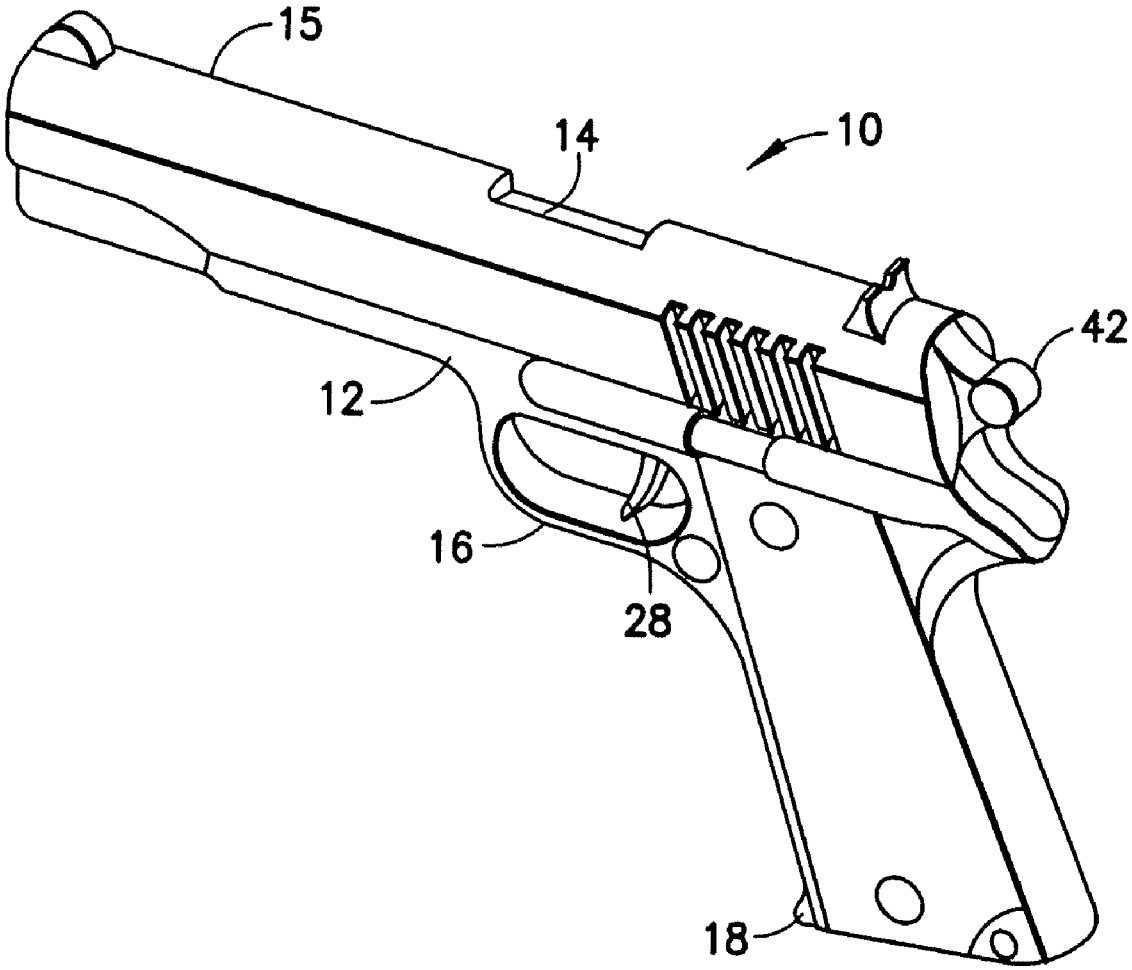
FIG. 1 is a left side isometric view of a pistol incorporating features in accordance with one exemplary embodiment of the present invention.

Referring to FIG. 1, there is shown an isometric view of a firearm 10 incorporating features of an exemplary embodiment. The firearm 10 is illustrated as a model 1911 pistol semi-automatic, though various features, as will be described further below, of the exemplary embodiments are equally applicable to any suitable firearm. Pistol 10 may be a single or double action pistol, and the features described are equally suitable to other semiautomatic pistols. Pistol 10 may have operational features, such as disclosed in U.S. patent application Ser. No. 11/305,391 Filed on Dec. 6, 2005 which is hereby incorporated by reference in its entirety. The pistol 10 has a receiver or frame 12, a barrel 14, a breach slide 15, a firing mechanism 16, and a removable cartridge magazine 18. Although the present invention will be described with the reference to the exemplary embodiments shown in the drawings, it should be understood that the present invention can be embodied in various different types and kinds of alternate embodiments and different types and kinds of firearms. In addition, any suitable size, shape or type of elements or materials could be used.

Figure 2:
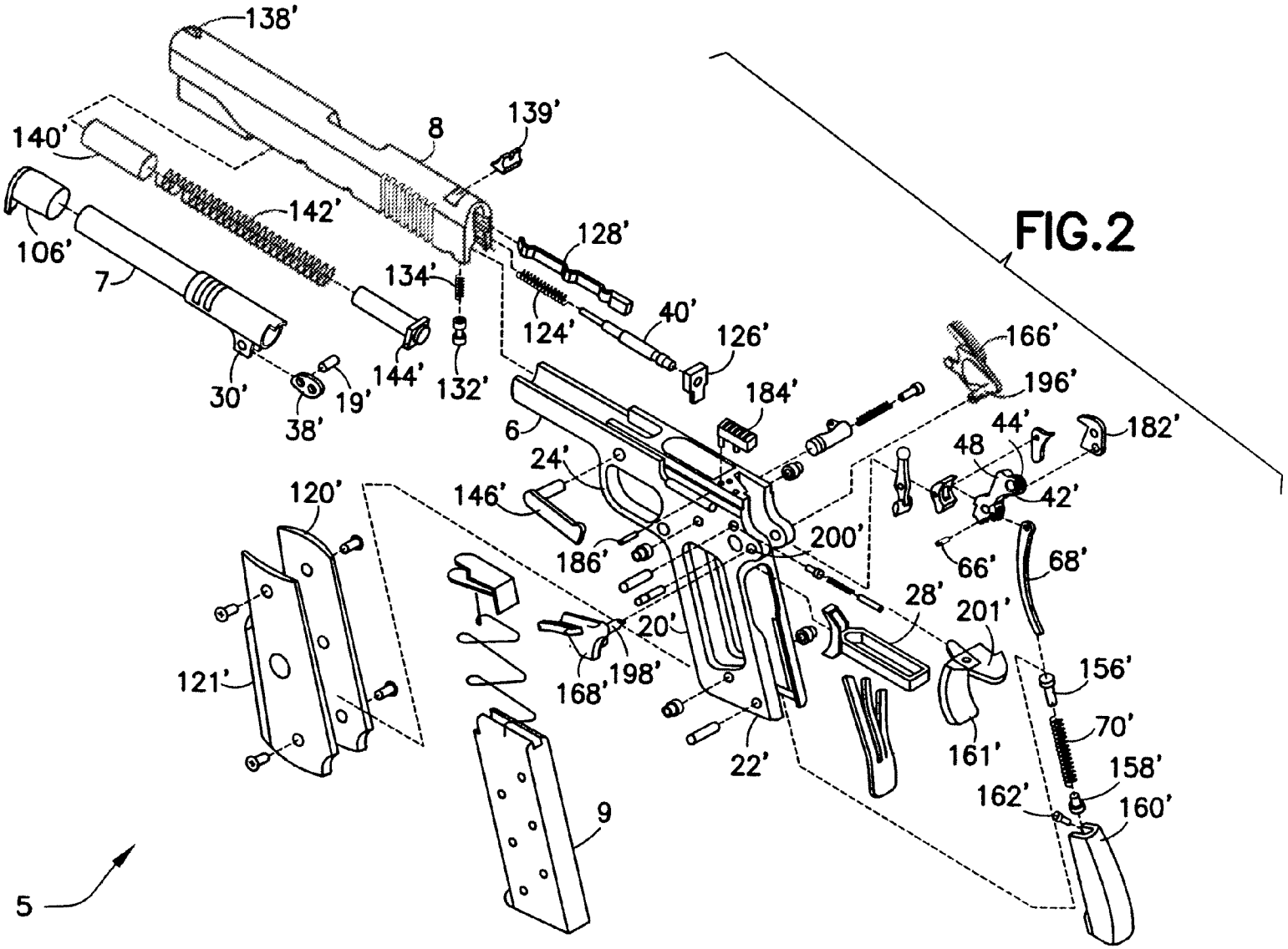
FIG. 2 is a exploded isometric view of the pistol.

Referring now to FIG. 2, there is shown a partial exploded isometric view of a semiautomatic pistol 5. Pistol 5, substantially similar to firearm 10 in FIG. 1, in this embodiment is a model 1911 semi-automatic pistol, such as manufactured by Colt's Manufacturing Corp., and the components of the pistol are substantially the same as a model 1911 pistol except as otherwise described below. In this exemplary embodiment, pistol 5 is capable of single action operation as will be described below. The pistol 5 has a receiver or frame 6, a barrel 7, a breach slide 8, a firing mechanism, and a removable cartridge magazine 18. The frame 6 has a stock or handgrip section 20' with a cartridge magazine receiving area 22' and a trigger guard section 24'. The barrel 7 has a bottom rear lug 30'. A barrel link 38' connects the lug 30 to the frame 6 with a pin 19'. Slide 8 is slidingly mounted to the top of the frame 6. Barrel 7 is located in a main channel of the slide 8 and guided by barrel bushing 106'. Firing pin 40' is preloaded by firing pin spring 124' against firing pin stop 126'. Extractor 128' is also retained in the slide by firing pin stop 126' for ejection of spent cartridges. A firing pin plunger 132' and plunger spring 134' are provided to prevent the firing pin from advancing to the cartridge when the firing pin is improperly engaged. Plunger lever 182' is pivotally coupled to frame 6. Firing pin 40', firing pin plunger 132', spring 134' and lever 182' may be substantially similar to those disclosed in U.S. Pat. No. 4,555,861, incorporated by reference herein in its entirety. Front and rear sights 138', 139' are on slide 8. Recoil spring plug 140' is coupled to slide 8 housing recoil spring 142', the opposite end of which engages recoil spring guide 144' coupled to frame 6. Slide stop 146' is pivotally mounted in frame 6. In alternate embodiments other types of barrels and/or barrel mounting systems could be provided. In alternate embodiments, any suitable type of slide could also be provided. In addition, any suitable type of firing pin or striker could be provided. Ejector 184' and ejector pin 186' cooperate with an extractor to eject spent cartridges from firearm 5 after firing. Pistol 5 includes two handgrip panels 120', 121' with handgrip panels 120', 121' are substantially the same as model 1911 pistol handgrip panels. The panels are mounted to the frame 6 on opposite sides of the handgrip section 20'. The panels may be fastened to the handgrip section of the pistol frame using any suitable method. The firing mechanism includes the trigger assembly 28', the firing pin 40' and a hammer assembly 42'. Hammer assembly 42' includes hammer member 44' having a striking face 48. Pin 66' mounts strut 68' to hammer 44'. Strut 68' is spring loaded by a spring 70' against the strut pin 66'. The strut 68' engages spring 70' through mainspring cap 156'. Spring 70' engages mainspring housing 160' through mainspring retainer pin 158' and roll pin 162'. An ambidextrous thumb safety coupled to receiver 6 is provided as selectors 166', 168'. Right and left selectors or decocking levers 166', 168' are pivotally mounted by posts 196', 198' through bore 200' in receiver frame 6 and bore 201 in housing 161'. In the embodiment shown, decocking levers 166', 168' are interlocked thereby allowing decocking of the hammer 42 by operating either the left or right lever. For example, the respective posts 196', 198' may have keyed features that interlock when assembled to the frame where the rotational motion of one is imparted to the other. The levers 166', 168' may be rotated relative to the frame about posts 196', 198' between a down position and an up or decocking position. The decocking levers may be biased in the down position by a spring. The right and left decocking levers 166', 168' may be provided to release a cocked hammer without firing the weapon. In alternate embodiments other types of decocking assemblies could be provided. For example, instead of providing an ambidextrous safety operable from either side of firearm 5, a single right hand or left hand decocking or safety lever may be provided. As a further example, levers 166', 168' may be rotated relative to the frame about posts 196', 198' between a first upper safety position and a lower decocking position with an intermediate firing position. As a further example alternate embodiment, levers 166', 168' may be provided with any suitable number of positions or functions.

Figure 3:
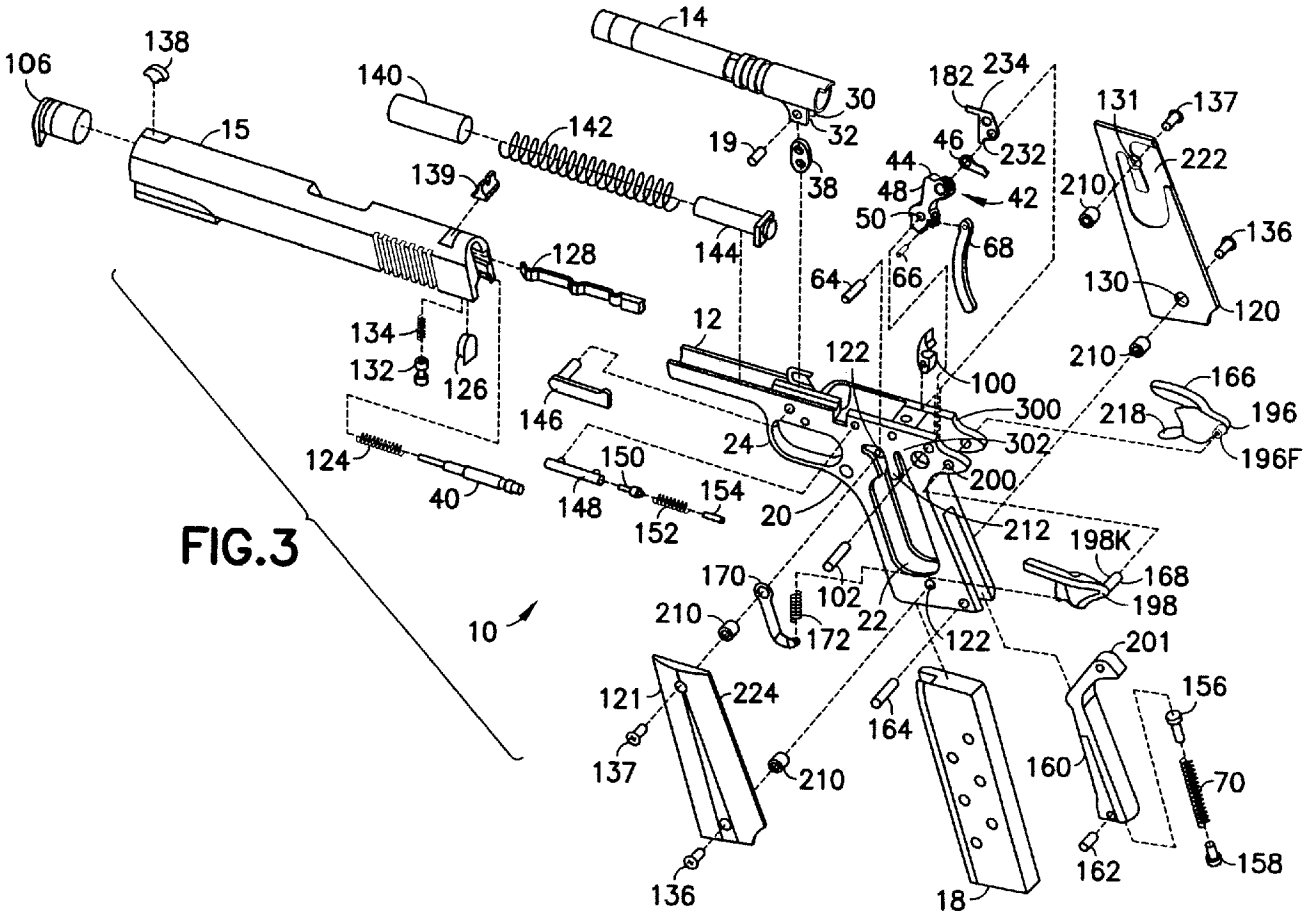
FIG. 3 is a partial exploded isometric view of a pistol in accordance with another exemplary embodiment.
Figure 3A:
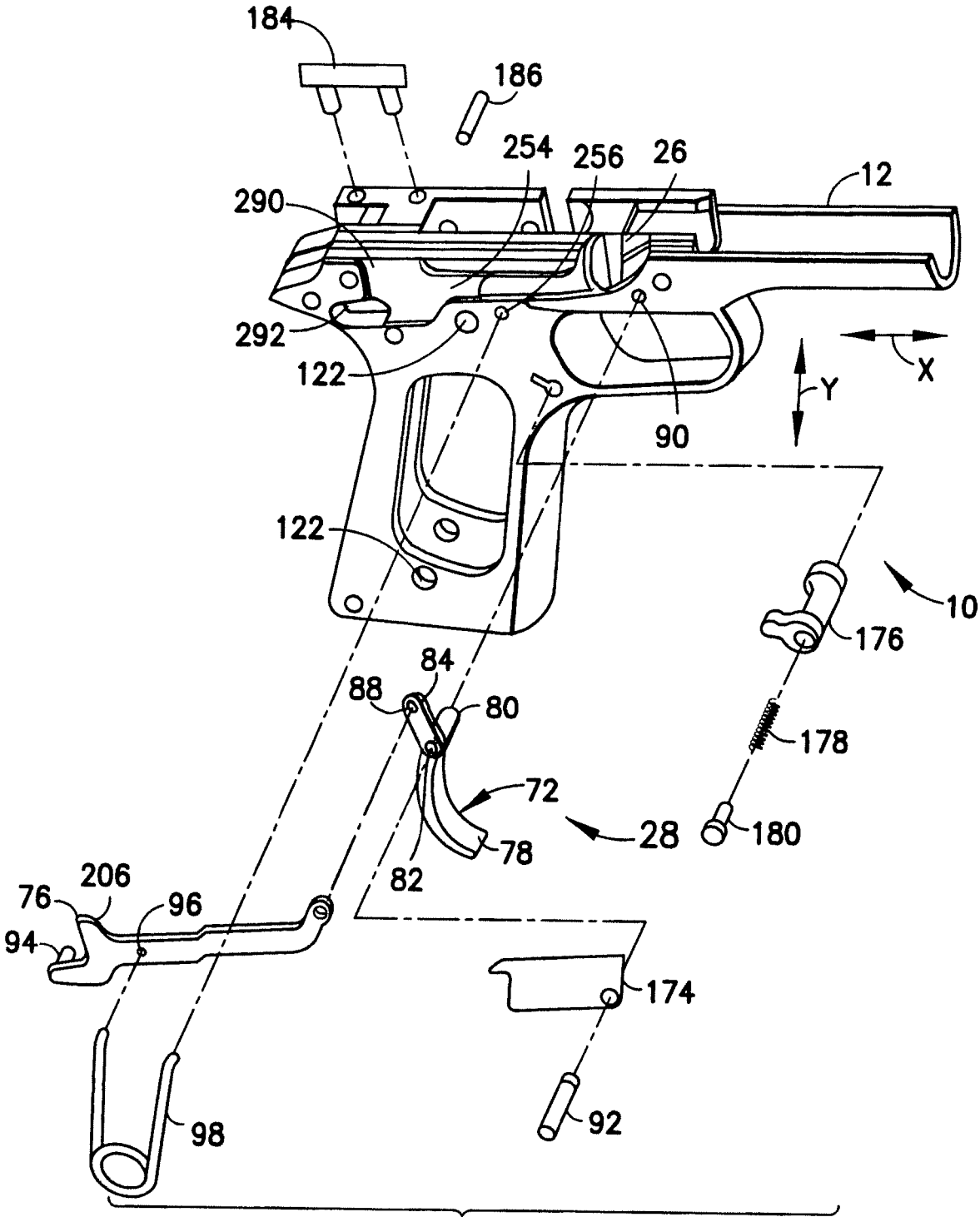
FIG. 3A is a right side partial exploded isometric view of the pistol shown in FIG. 3.

Referring also to FIGS. 3 and 3A, a partial exploded isometric view of the pistol 10 (see also FIG. 1) is shown. As noted above pistol 10 in this embodiment is a model 1911 semi-automatic pistol, such as manufactured by Colt's Manufacturing Corp., and the components of the pistol are substantially the same as a model 1911 pistol except as otherwise described below. In this exemplary embodiment, pistol 10 is capable of both double action and single action operation as will be described below. The frame 12 has a stock or handgrip section with a cartridge magazine receiving area 22, a trigger guard section 24 and a slot for the trigger assembly. The barrel 14 has a bottom rear lug 30 having a slot 32. A barrel link 38 connects the lug 30 to the frame 12 with a pin 19 through the slot 32. Slide 15 is slidingly mounted to the top of the frame 12. Barrel 14 is located in a main channel of the slide 15 and guided by barrel bushing 106. Firing pin 40 is preloaded by firing pin spring 124 against firing pin stop 126. Extractor 128 is also retained in the slide by firing pin stop 126 for ejection of spent cartridges. A firing pin plunger 132 and plunger spring 134 are provided to prevent the firing pin from advancing to the cartridge when the firing pin is improperly engaged. Plunger lever 182 is pivotally coupled to frame 12 with hammer pin 64. Firing pin 40, firing pin plunger 132, spring 134 and lever 182 may be substantially similar to those disclosed in U.S. Pat. No. 4,555,861, incorporated by reference herein in its entirety. Plunger lever 182 has protrusions 232 and 234 that cooperate with the draw bar 76 in combination with trigger 28 to rise the firing pin plunger 132 and allow the firing pin to advance to the cartridge when the firing pin is properly engaged by hammer assembly 42. Front and rear sights 138, 139 are on slide 15. Recoil spring plug 140 is coupled to slide 15 housing recoil spring 142, the opposite end of which engages recoil spring guide 144 coupled to frame 12. Slide stop 146 is pivotally mounted in frame 12. Plunger tube 148, slide stop plunger 150, plunger spring 152 and spiral pin 154 are mounted to frame 12. In alternate embodiments other types of barrels and/or barrel mounting systems could be provided. In alternate embodiments, any suitable type of slide could also be provided. In addition, any suitable type of firing pin or striker could be provided. Magazine catch 176, magazine catch and gate spring 178 and magazine catch lock 180 are provided coupled to frame to retain and release the magazine 18. Ejector 184 and ejector pin 186 cooperate with extractor 218 to eject spent cartridges from firearm 10 after firing. Pistol 10 includes two handgrip panels 120, 121 with handgrip panels 120, 121 are substantially the same as model 1911 pistol handgrip panels. The panels 120 are mounted to the frame 12 on opposite sides of the handgrip section 20. In this embodiment, the handgrip section 20 has fastener holes 122 on each side. The holes 122 are located at top and the bottom of the handgrip section respectively. The right side panel 120 has matching holes 130, 131. Fasteners 136, 137 are inserted into holes 130, 131 and screwed into the bushings 210 where the bushings 210 are inserted into the holes 122 of frame 12. In alternate embodiments, the panels may be fastened to the handgrip section of the pistol frame using any other suitable means such as snap on detents. Firing mechanism 16 includes the trigger assembly 28, the draw bar 76, the firing pin 40 and a hammer assembly 42. Hammer assembly 42 includes a first hammer member 44 and a second hammer member 46 movably or pivotally mounted to the hammer. The hammer hook 46 engages a hammer engagement end of the draw bar 76 to move the draw bar forward (and therefor the trigger) when the pistol is being fired in single action mode. The first hammer member 44 has a striking face 48 and a mounting hole 50. Hammer pin 64 extends through the hole 50 the hammer hook in the hammer member and the hammer assembly 42 to the frame 12. Pin 66 is mounts strut 68 to hammer 44. Strut 68 is spring loaded by a spring 70 against the strut pin 66. The strut 68 engages spring 70 through mainspring cap 156. Spring 70 engages mainspring housing 160 through mainspring retainer pin 158 and roll pin 162. An ambidextrous thumb safety coupled to receiver 12 is provided as selectors 166, 168. Right and left selectors or decocking levers 166, 168 are pivotally mounted by posts 196, 198 through bore 200 in receiver frame 12 and bore 201 in mainspring housing 160. In the embodiment shown, decocking levers 166, 168 are interlocked thereby allowing decocking of the hammer 42 by operating either the left or right lever. For example, the respective posts 196, 198 may have keyed features 196K, 198K that interlock when assembled to the frame where the rotational motion of one is imparted to the other. Surface 218, of decocking lever 166 may be captured behind recess 222 of grip 120 capturing the lever after the grips are assembled to the frame 12. Thus mounted, the levers 196, 198 may be rotated relative to the frame about posts 196, 198 between a down position and an up or decocking position. The decocking levers may be biased in the down position by spring 172. Decocking lever spring bracket 170 is coupled to frame 12 by bushing 210 through hole 204 and 122 of frame 12 and within frame 12 by groove or slot 212 in frame 12. The right and left decocking levers 166, 168 may be provided to release a cocked hammer without firing the weapon. In alternate embodiments other types of decocking assemblies could be provided. For example, instead of providing an ambidextrous safety operable from either side of firearm 10, a single right hand or left hand decocking or safety lever may be provided. As a further example, levers 196, 198 may be rotated relative to the frame about posts 196, 198 between a first upper safety position and a lower decocking position with an intermediate firing position. As a further example alternate embodiment, levers 166, 168 may be provided with any suitable number of positions or functions. Referring also to FIG. 3, a partial exploded isometric view of the pistol 10 is shown. The trigger assembly 28 generally comprises a trigger member 72 and a draw bar 76. The trigger member 72 has a bottom finger contact section 78, a middle section with a pocket 80 and a mounting hole 82, and a top section 84 with a side projection 88. The top section and side projection 88 define the offset crank of the trigger. The width of the finger contact section 78 is about the same width of the slot 26 in the frame 12. A trigger pin extends through the holes 82, 90 and also retains side plate 174 covering draw bar 76. The pin 92 is connected to the frame 12 across the slot 26 (not shown) through hole 90. This pivotably mounts the trigger member 72 to the frame 12. The top section 84 is relatively thin and extends from only this right side of the trigger member 72. Draw bar 76 may be mounted in a groove 254 of the receiver frame 12. Groove or channel 254 is formed into the outer side of the receiver frame 12 and has access opening 290 allowing raised cam 206 on the draw bar to contact and engage slide rail 15. Frame 12 has cutout 292 to allow engagement finger 94 on draw bar 76 to extend through the receiver and respectively engage the hammer, for hammer cocking action, and engage the sear 100 for firing as compared to a conventional 1911 that has no cutout. The rear end of the bar 76 may have an inwardly extending lateral projection 94 and a hole 96. A spring 98 is provided with one end connected to the frame 12 at hole 256 and an opposite end connected to the draw bar 76 at the hole 96.

Figure 4A:
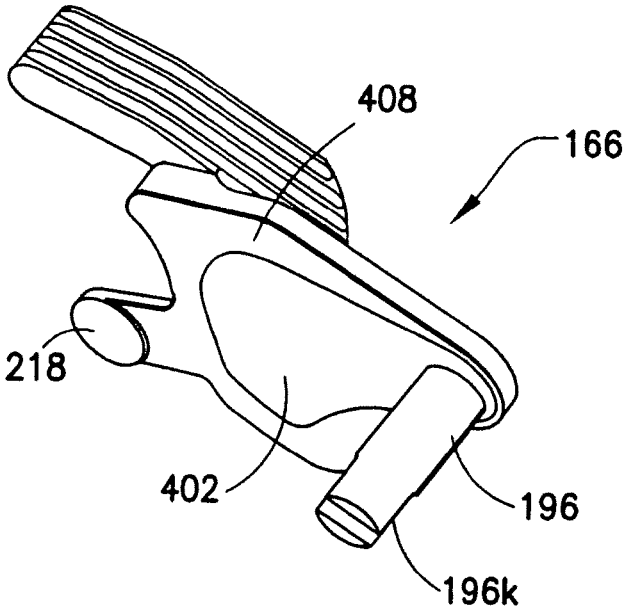
FIGS. 4A, 4B and 4C are isometric views of a right safety selector.
Figure 4B:
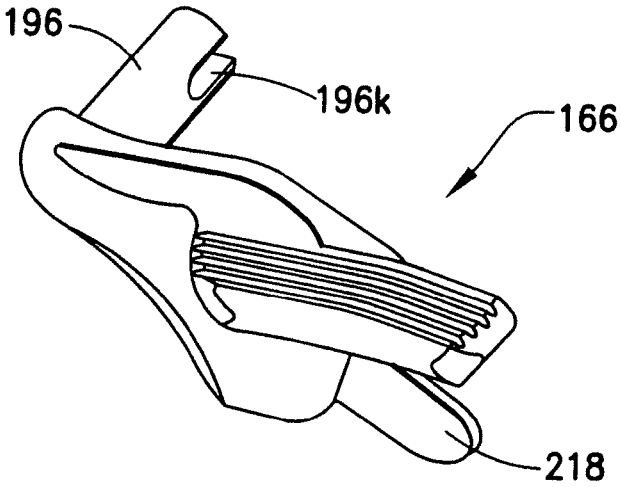
Figure 4C:
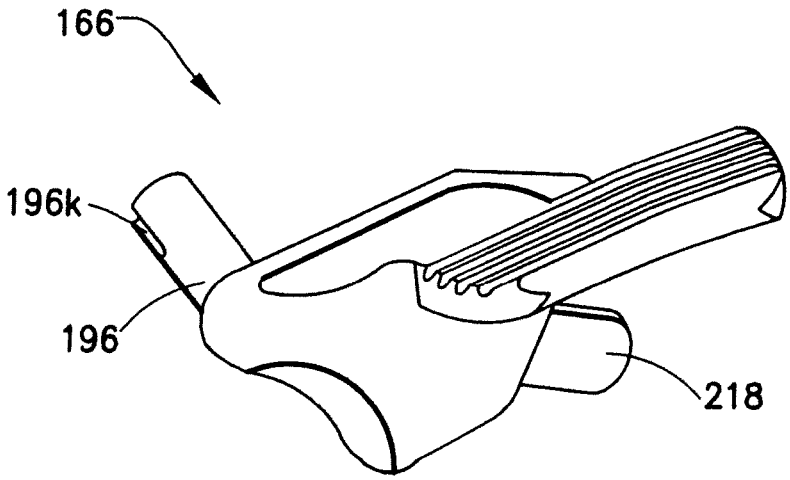
Figure 5A:
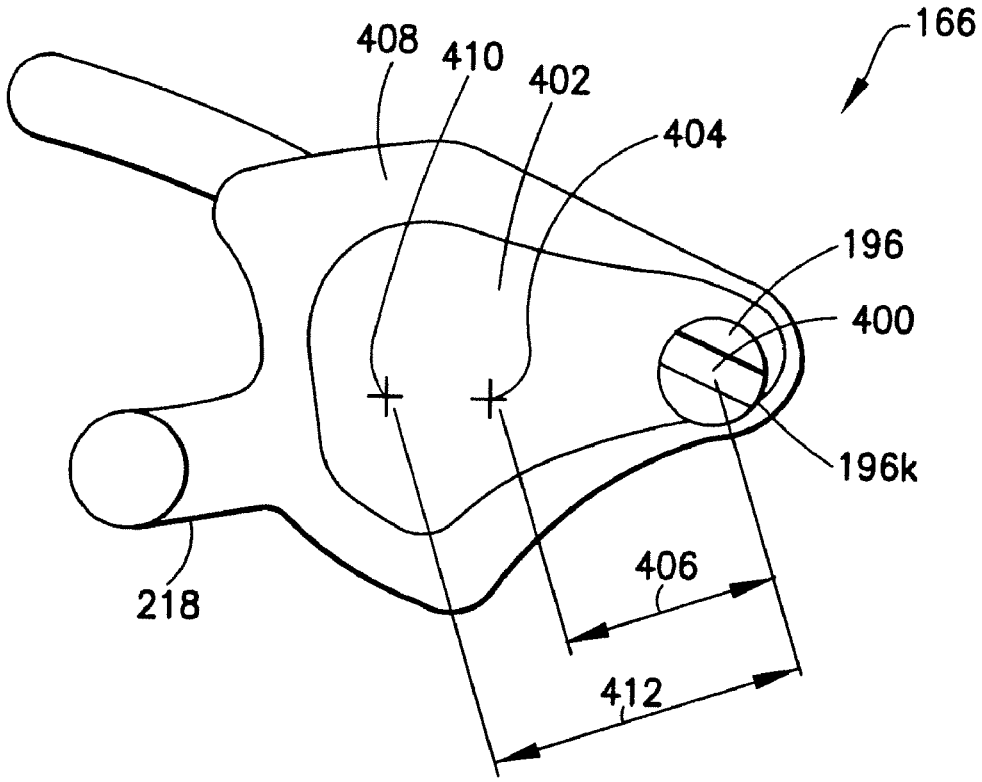
FIGS. 5A and 5B are left and rear views respectively of the right decocking lever shown in FIGS. 4A-4C.
Figure 5B:
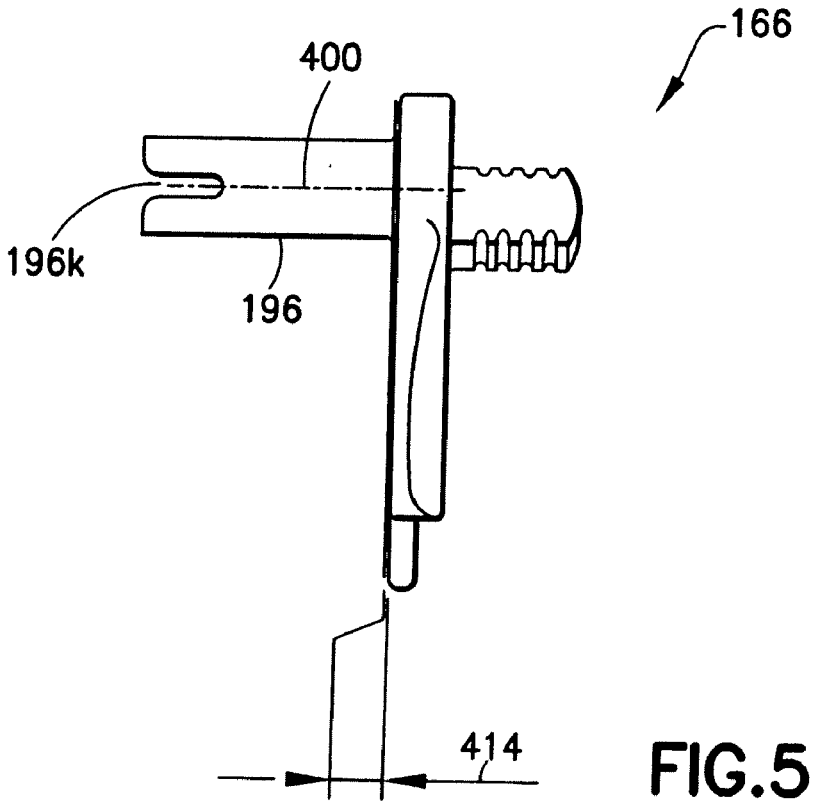
Figure 8:
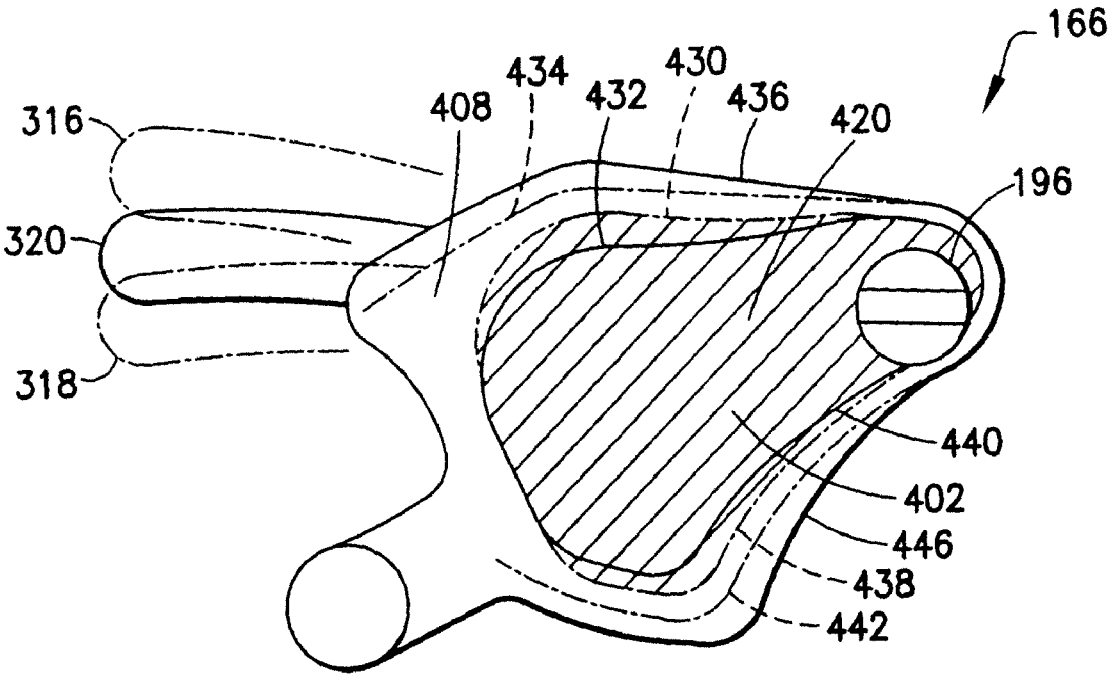
FIG. 8 is a left view of the decocking lever shown in FIGS. 4A-4C.

Referring now to FIGS. 4A, 4B and 4C, there are shown isometric views of right safety selector 166. Referring also to FIGS. 5A and 5B are right and rear views respectively of right decocking lever 166. Right lever 166 is pivotally mounted by post 196 to receiver frame 12. Decocking lever 166 may be interlocked to lever 168 whereby keyed interlocking feature 196K mates with the corresponding keyed interlocking feature 198K of lever 198. Surface 218 of lever 166 may be provided and captured behind grip 120 capturing the lever after the grips are assembled to the frame 12. Surface 218 may be raised or have any suitable shape with respect to the lever 166. Right decocking lever 166 may be provided as a safety and/or to release a cocked hammer without firing the weapon. In alternate embodiments other types of decocking levers could be provided. As an example, and referring also to FIG. 8, lever 166 may be rotated relative to frame 12 about post 196 between a first upper safety position 316 and a lower decocking position 318 with an intermediate firing position 320. As a further example alternate embodiment, lever 166 may be provided with any suitable number of positions or functions. Left selector 166 is provided pivotally coupled to a first side 300 of frame 12 (see FIG. 2) about an axis of rotation 400 corresponding to the centerline of post 196. Here, first side 300 of the model 1911 receiver 12 is shown opposite second side 302. Right selector 166 has a right flat surface portion 402 offset from axis of rotation 400 and contacting first side 300 when assembled to firearm 10. Here, the centroid 404 of the surface portion 402 is offset by a distance 406 from axis of rotation 400. Right selector 166 has a right raised surface portion 408 offset from axis of rotation 400 and also facing first side 300. Here, the centroid 410 of the surface portion 408 is offset by a distance 412 from axis of rotation 400. Right raised surface 408 is raised relative to flat surface portion 402 by a distance 414. In the embodiment shown, surface 408 is shown as a flat surface and parallel to side 300 of receiver 12 separated by a minimum gap 414 where surface 408 may not contact receiver 12. In alternate embodiments, any suitable surface may be provided. Right flat surface portion 402 covers a first swept area 420 when safety 166 is rotated from first position 316 to the second position 318. Swept area 420 is shown in FIG. 8 as a crosshatched area and reflects the area swept by surface 402 relative to receiver 12 during operation of safety 166 where contact with receiver 12 or other components of pistol 10 may occur resulting in a surface appearance change. As can be seen in FIG. 8, right swept area 420 is covered by the right raised surface portion 408 in either first position 316 or second position 318 and in between. To further illustrate, the upper bounds 430 of swept area 420 caused by upper edge 432 of surface 402 when selector 166 is in the first position 316 is covered by the upper bounds 434 of surface 408 caused by upper edge 436 of surface 408 when selector 166 is in the second position 318. Similarly, and to further illustrate, the lower bounds 438 of swept area 402 caused by lower edge 440 of surface 402 when selector 166 is in the second position 318 is covered by the lower bounds 442 of surface 408 caused by lower edge 446 of surface 408 when selector 166 is in the first position 316. Here, as surface 402 covers the swept area 420, any portion of swept area 420 that may cause a distinguishable pattern on receiver 12 or otherwise is covered and not exposed to the user. Accordingly, there is provided a movable selector 168 that does not provide a distinguishable pattern on the receiver with continued use improving the value of firearm 10.

Figure 6A:
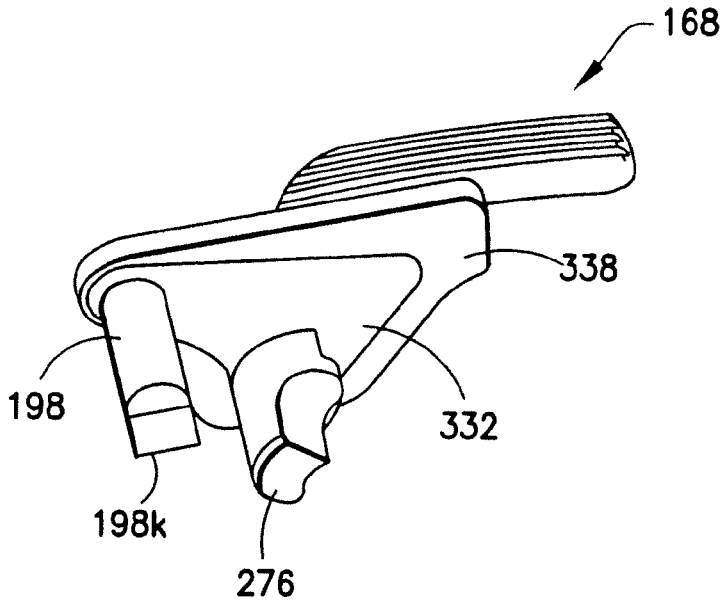
FIGS. 6A, 6B and 6C are isometric views of a left safety selector.
Figure 6B:
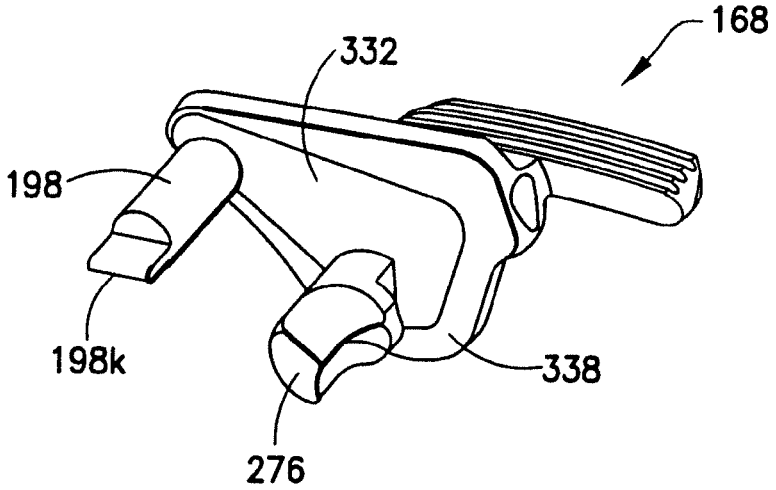
Figure 6C:
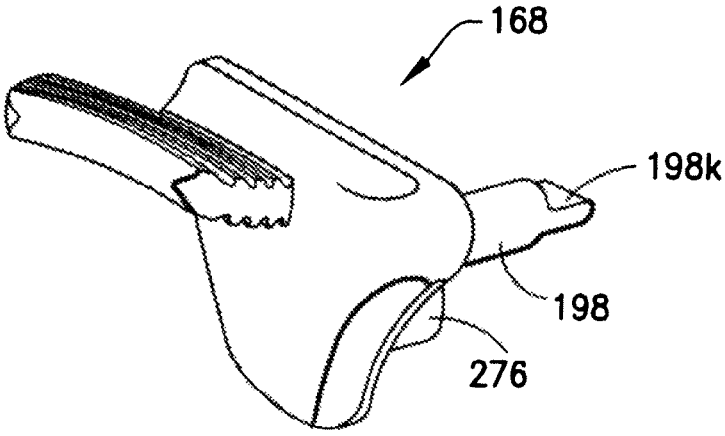
Figure 7A:
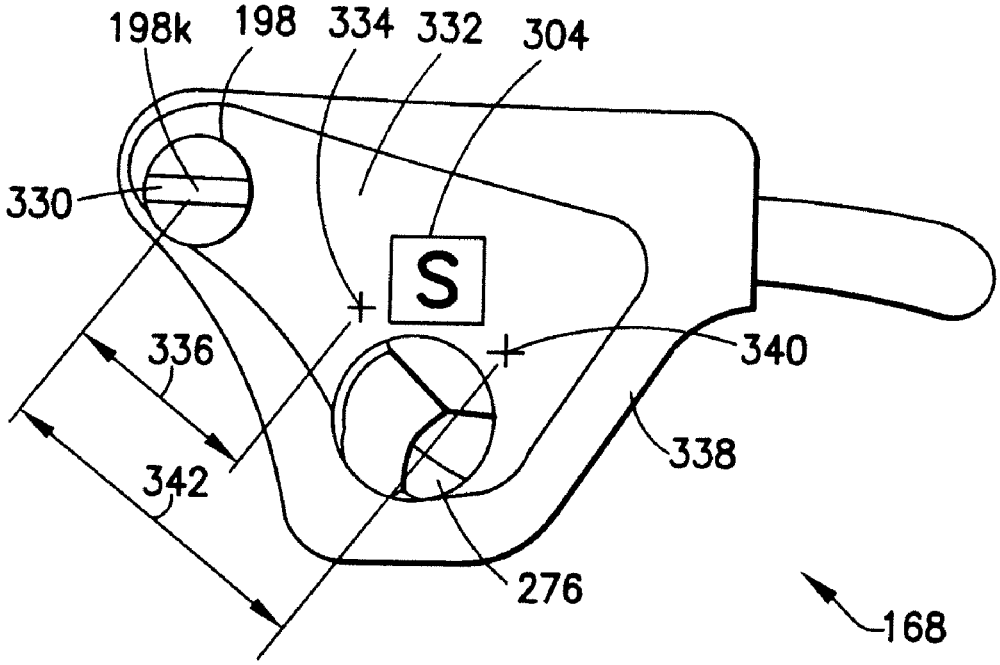
FIGS. 7A and 7B are right and rear views respectively of the left decocking lever shown in FIGS. 5A-5C.
Figure 7B:
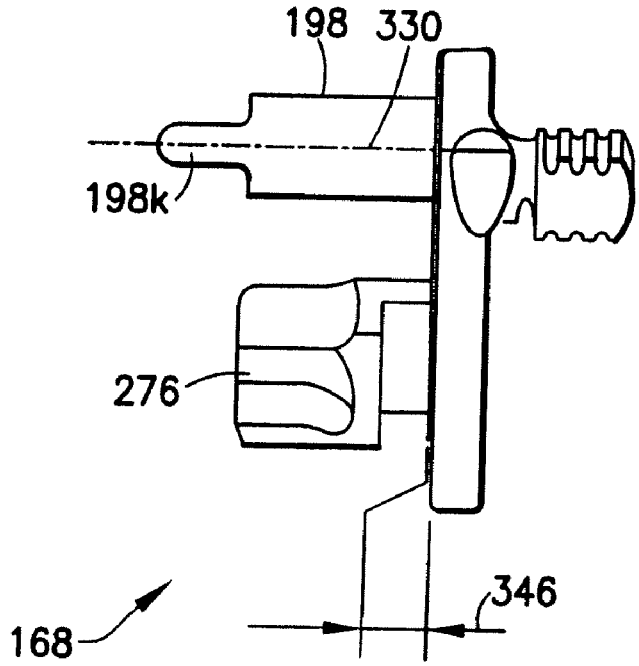
Figure 9:
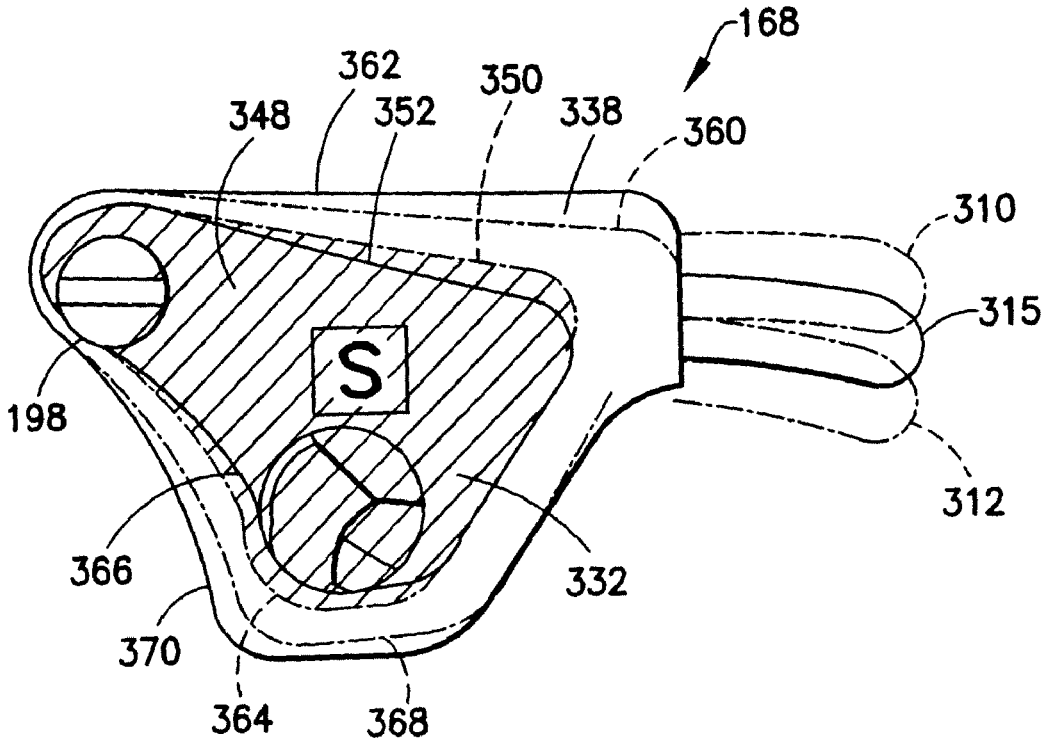
FIG. 9 is a right view of the decocking lever shown in FIGS. 6A-6C.

Referring now to FIGS. 6A, 6B and 6C, there are shown isometric views of left safety selector 168. Referring also to FIGS. 7A and 7B are right and rear views respectively of left decocking lever 168. Left lever 168 is pivotally mounted by post 198 to receiver frame 12. Decocking lever 168 has a engagement member 276, for example for engagement of the sear 100 when decocking the hammer. In alternate embodiments, any other suitable members or lever functions may be used. In this embodiment, member 276 is disposed on lever 168 and in alternate embodiments the decocking member are any suitable member may be disposed on any desired lever. Decocking lever 168 may be interlocked to lever 166 whereby keyed interlocking feature 198K mates with the corresponding keyed interlocking feature 196K of lever 196. Although not shown, and in alternate embodiments, surfaces of lever 168 may be provided and captured behind grip 121 capturing the lever after the grips are assembled to the frame 12. The left decocking lever 168 may be provided as a safety and/or to release a cocked hammer without firing the weapon. In alternate embodiments other types of decocking levers could be provided. As an example, and referring also to FIG. 9, lever 168 may be rotated relative to frame 12 about post 198 between a first upper safety position 310 and a lower decocking position 312 with an intermediate firing position 314. As a further example alternate embodiment, lever 168 may be provided with any suitable number of positions or functions. Identification feature 304 may be provided on lever 168. Left selector 168 is provided pivotally coupled to a second side 302 of frame 12 (see FIG. 2) about an axis of rotation 330 corresponding to the centerline of post 198. Here, second side 302 of the model 1911 receiver 12 is shown opposite first side 300. Left selector 168 has a left flat surface portion 332 offset from axis of rotation 330 and contacting second side 302 when assembled to firearm 10. Here, the centroid 334 of the surface portion 332 is offset by a distance 336 from axis of rotation 330. Left selector 168 has a left raised surface portion 338 offset from axis of rotation 330 and also facing second side 302. Here, the centroid 340 of the surface portion 338 is offset by a distance 342 from axis of rotation 330. Left raised surface 338 is raised relative to flat surface portion by a distance 346. In the embodiment shown, surface 338 is shown as a flat surface and parallel to side 302 of receiver 12 separated by a minimum gap 346 where surface 338 may not contact receiver 12. In alternate embodiments, any suitable surface may be provided. Left flat surface portion 332 covers a second swept area 348 when safety 168 is rotated from first position 310 to the second position 312. Swept area 348 is shown in FIG. 9 as a crosshatched area and reflects the area swept by surface 332 relative to receiver 12 during operation of safety 168 where contact with receiver 168 or other components of pistol 10 may occur resulting in a surface appearance change. As can be seen in FIG. 9, left swept area 348 is covered by the left raised surface portion 338 in either first position 310 or second position 312 and in between. To further illustrate, the upper bounds 350 of swept area 348 caused by upper edge 352 of surface 332 when selector 12 is in the first position 310 is covered by the upper bounds 360 of surface 338 caused by upper edge 362 of surface 338 when selector 168 is in the second position 312. Similarly, and to further illustrate, the lower bounds 364 of swept area 348 caused by lower edge 366 of surface 332 when selector 168 is in the second position 312 is covered by the lower bounds 368 of surface 338 caused by lower edge 370 of surface 338 when selector 168 is in the first position 310. Here, as surface 338 covers the swept area 348, any portion of swept area 338 that may cause a distinguishable pattern on receiver or otherwise is covered and not exposed to the user. Accordingly, there is provided a movable selector 168 that does not provide a distinguishable pattern on the receiver with continued use improving the value of firearm 10.

It should be understood that the foregoing description is only illustrative of the invention. Various alternatives and modifications can be devised by those skilled in the art without departing from the invention. For example, the approach taken on the selector may be applied to any suitable firearm component. Accordingly, the present invention is intended to embrace all such alternatives, modifications and variances which fall within the scope of the appended claims.

What is claimed is:

1. A semiautomatic pistol thumb safety capable of being coupled to a receiver of a semiautomatic pistol, the thumb safety comprising:

a selector adapted to be movably mounted to the receiver so that when mounted to the receiver the selector is movable relative to the receiver between battery and safe positions, the selector comprising:

a receiver contact surface disposed to contact a first exterior surface of the receiver when the selector is in the battery position and a second exterior surface of the receiver when the selector is in the safe position, wherein the receiver contact surface is arranged so that at least one of the first and second exterior surfaces of the receiver is uncovered by the receiver contact surface when the selector is in or moved between battery and safe positions; and a masking section connected to the receiver contact surface and arranged to hide the at least one of the uncovered first and second exterior surfaces of the receiver substantially in their entirety regardless of position of the selector so that both of the uncovered first and second exterior surfaces are hidden.

2. A model 1911 semiautomatic pistol thumb safety adapted to be coupled to a model 1911 receiver, the thumb safety comprising:

a selector adapted for being movably coupled to the receiver, the selector having a substantially flat portion disposed to extend adjacent to and alongside an exterior side of the receiver, the flat portion having an operator actuating tab projecting from an outer surface of the flat portion and having an interior surface arranged to face the exterior side of the receiver, when the selector is coupled to the receiver, the interior surface having different offset surface sections differently offset outwards from the exterior side of the receiver when the selector is coupled to the receiver;

wherein one of the offset surface sections is substantially surrounded by another of the offset surface sections having the outermost offset surface.

3. The safety of claim 2, wherein the one of the offset surface sections is a contact surface disposed to contact the exterior side of the receiver, wherein, when coupled to the receiver the safety is movable relative to the receiver from a first position to a second position, and wherein the contact surface sweeps an area of the receiver when the safety is moved from the first position to the second position, and the swept area is hidden, with the safety in either the first position or the second position by the other of the offset surface sections that is raised relative to the contact surface.

4. The safety of claim 3, wherein the first position is a safe position, and wherein the second position is a firing position.

5. The safety of claim 3, wherein the first position is an upper safety position, and wherein the second position is a lower de-cock position.

6. The safety of claim 2, wherein the model 1911 semiautomatic pistol is adapted for both single action and double action operation.

7. The safety of claim 3, wherein the another of the offset surface sections comprises a raised surface parallel to the contact surface, and wherein there is a spaced gap between the raised surface and the receiver when the selector is coupled to the receiver.

8. An ambidextrous thumb safety adapted to be coupled to a model 1911 receiver, the safety comprising:

a right selector capable of being pivotally coupled to a first side of the model 1911 receiver so that when coupled, the right selector can pivot relative to the receiver about an axis of rotation, the right selector having a right surface portion arranged for contacting the first side, and having a right raised surface portion offset from the right surface portion and disposed to face the first side when the right selector is coupled to the first side, the offset of the right raised surface portion relative to the right surface portion being away from the first side when the right selector is coupled to the receiver;

a left selector capable of being pivotally coupled to a second side of the model 1911 receiver, opposite the first side so that when coupled, the left selector can pivot relative to the receiver about the axis of rotation, the left selector being interconnectable to the right selector and having a left surface portion arranged for contacting the second side, and a left raised surface portion offset from the left surface portion and disposed to face the second side when the left selector is coupled to the second side, the offset of the left raised surface portion relative to the left surface portion being away from the second side when the left selector is coupled to the receiver;

wherein when coupled to the receiver, the safety is rotatable relative to the receiver from a first position to a second position, and wherein the right surface portion sweeps a right swept area on the receiver, when the safety is rotated from the first position to the second position, and the right swept area is covered substantially in its entirety by the right raised surface portion when the safety is in both the first position and the second position, and wherein the left surface portion sweeps a left swept area on the receiver, when the safety is rotated from the first position to the second position, and the left swept area is covered substantially in its entirety by the left raised surface portion when the safety is in both the first position and the second position.

9. The safety of claim 8, wherein the first position is a safe position, and wherein the second position is a firing position.

10. The safety of claim 8, wherein the first position is a safety position, and wherein the second position is a de-cock position.

11. The safety of claim 8, wherein the model 1911 semiautomatic pistol is adapted for at least one of single action or double action operation.

12. The safety of claim 8, wherein the right raised surface portion is substantially parallel to the right surface portion, and when the right selector is coupled to the receiver there is a right spaced gap between the right raised surface portion and the first side, and wherein the left raised surface portion is substantially parallel to the left surface portion, and there is a left spaced gap between the left raised surface portion and the second side when the left selector is coupled to the receiver.

13. The safety of claim 8, wherein the right raised surface portion substantially surrounds the right surface portion, and the left raised surface portion substantially surrounds the left surface portion.

14. A semiautomatic pistol comprising:

a receiver;

a barrel coupled to the receiver;

a breach slide coupled to the receiver;

a firing mechanism coupled to the receiver; and a selector movably coupled to the receiver, the selector having a substantially flat portion disposed to extend adjacent to and alongside an exterior side of the receiver, the flat portion having an operator actuating tab projecting from an outer surface of the flat portion and having an interior surface arranged to face the exterior side of the receiver, the interior surface having different offset surface sections differently offset outwards from the exterior side of the receiver when the selector is coupled to the receiver;

wherein one of the offset surface sections is a contact surface disposed to contact the exterior side of the receiver and wherein, the safety is movable relative to the receiver from a first position to a second position, and wherein the contact surface sweeps an area of the receiver when the safety is moved from the first position to the second position, and the swept area is hidden substantially in its entirety, with the safety in both the first position and the second position by another of the offset surface sections that is raised relative to the contact surface.

15. The semiautomatic pistol of claim 14 wherein the first position is a safe position, and wherein the second position is a firing position.

16. The semiautomatic pistol of claim 14, wherein the pistol is a model 1911 semi-automatic pistol.

17. The semiautomatic pistol of claim 14, wherein the selector is an ambidextrous selector, and wherein the pistol is a model 1911 semi-automatic pistol.

18. The semiautomatic pistol of claim 14, wherein the pistol is a model 1911 semi-automatic pistol, and wherein the first position is a safety position, and wherein the second position is a de-cock position.

19. The semiautomatic pistol of claim 14, wherein the semiautomatic pistol is adapted for at least one of single action or double action operation.

* * * * *